United States Patent [19]

Gustafson

[11] Patent Number: 4,625,753

[45] Date of Patent: Dec. 2, 1986

[54] CONTAINER FOR RECEIVING, STORING, AND DISPENSING CRYOGENIC FLUIDS

[76] Inventor: Keith W. Gustafson, Station 1101, Lake Arrowhead, Waleska, Ga. 30183

[21] Appl. No.: 753,483

[22] Filed: Jul. 10, 1985

[51] Int. Cl.[4] ..... F17C 7/02

[52] U.S. Cl. ..... 137/202; 137/210; 62/55

[58] Field of Search ..... 137/209, 210, 202; 141/18, 3, 285, 310; 62/55, 54, 49; 220/88 VS, 88 VR

[56] References Cited

U.S. PATENT DOCUMENTS 2,764,873 10/1956 Mooyaart ..... 62/54 X
2,834,187 5/1958 Loveday ..... 62/54 X
2,884,943 5/1959 Dobrick ..... 137/202
2,912,830 11/1959 Coldren ..... 62/55 X
3,097,500 7/1963 More ..... 62/55

*Primary Examiner*—Alan Cohan
*Attorney, Agent, or Firm*—Dale Lischer; J. Rodgers Lunsford, III

[57] ABSTRACT

A cryogenic liquid storage tank has an automatic pressure relief means which vents vapor while the tank is being filled so that the tank may be completely filled. The pressure relief means includes a float which, when the cryogenic tank is filled, automatically closes the pressure relief means. In an alternative embodiment, the pressure relief means is combined with an eductor attached to the tank's inlet. The eductor entrains and condenses vapor within the tank to minimize the amount of vapor vented by the pressure relief means.

2 Claims, 5 Drawing Figures

CONTAINER FOR RECEIVING, STORING, AND DISPENSING CRYOGENIC FLUIDS

BACKGROUND OF THE INVENTION

This invention relates generally to a cryogenic fluid container, and more particularly concerns a cryogenic fluid container having means for relieving the internal head pressure during filling in order to fill completely the cryogenic container with cryogenic liquid.

Gases, having low boiling points at atmospheric pressure, such as carbon dioxide ($CO_2$) and oxygen ($O_2$), for example, present many difficulties and problems not encountered in handling ordinary gases. In order to provide $CO_2$ gas for use in fast food restaurants for carbonating soft drinks, for example, it has been necessary in the past to provide the compressed $CO_2$ in single or clustered high pressure containers which are really best suited for customers with low consumption or sporadic use. Such service is expensive because of the high cost of handling the necessary heavy containers the weight of which is very high in comparison to the weight of the compressed gas contained therein.

Customers having high or moderately high demands for $O_2$ or $CO_2$ gas have also been serviced by means of high pressure tubular receivers installed on their premises. Such receivers are periodically serviced by means of a pump equipped liquid tank truck which transports the material to the customer's premises in liquid form and charges such receivers with high pressure gas drawn from the vaporized liquid. These tank trucks must be specially equipped for this service and represent a large capital expense. Furthermore, the delivery of gas is time consuming owing to the limiting capacity of the portable high pressure pumps.

Another way of storing such low boiling point gases, such as $O_2$ and $CO_2$, is to store them in a cryogenic tank in liquid form on the user's premise. Such a cryogenic tank includes an inner vessel which holds the cryogenic liquid and an outer vessel within which the inner vessel is supported. There is an insulating space between the inner and outer vessels in which a vacuum is drawn and insulating material is positioned. Because of the low heat transfer from the ambient atmosphere outside of the outer vessel to the contents of the inner vessel, the liquid $O_2$ or $CO_2$ can remain in liquid form for some period of time before heat vaporization causes the vapor pressure of the $O_2$ or $CO_2$ to exceed a preset maximum pressure and to activate a regulator system for maintaining the vapor pressure within a safe range.

When such a cryogenic tank is installed on a customer's premises, such as a $CO_2$ tank in a fast food restaurant, it is necessary periodically to refill the cryogenic tank with liquid $CO_2$. The $CO_2$ tank is filled by means of a delivery truck carrying $CO_2$ liquid which makes its rounds from one customer to the next. In order to achieve the greatest efficiency, it is important to be able to fill the customer's tank as nearly full as possible without resorting to sophisticated high pressure pumps and/or regulator systems.

One way of filling of the cryogenic tank on the customer's premises is to attach, a single hose from the cryogenic tank on the transport truck to the inlet of the customer's cryogenic tank. The vapor pressure in the transport tank forces the liquid from the transport tank into the cryogenic tank on the customer's premises. As the liquid flows into the customer's cryogenic tank, the increasing volume of liquid in the customer's cryogenic tank compresses the vapor above the liquid into a smaller and smaller space until the vapor pressure in the customer's tank exactly equals the vapor pressure in the transport tank. At that point, transfer from the transport tank to the customer's tank ceases even though the customer's tank may be only partially full.

In order to relieve the vapor pressure in the customer's cryogenic tank, the prior art suggests various ways of liquifying the $CO_2$ vapor in the top of the customer's tank by means of eductors, J-shaped bubbler tubes, or J-shaped sprinkler tubes, all of which are shown in Remes et al. Ser. No. 448,729, filed Dec. 10, 1982.

Other cryogenic fluid systems have required the necessity of a high pressure pump on the delivery truck to increase the delivery pressure along with a skilled operator to vent the customer's tank to assure that it is completely filled.

SUMMARY OF THE INVENTION

It is therefore an object of the present invention to provide a cryogenic tank which provides means for automatic venting of the vapor pressure in the tank to assure that the tank is totally filled.

It is also an object of the present invention to provide a cryogenic tank in which the means for automatic pressure venting is combined with an eductor that entrains gas in the vapor space in the tank with the incoming liquid in order to liquify some of the gas in the vapor space to minimize the amount of gas that must be automatically vented during filling.

Other objects and advantages of the invention will become apparent upon reading the following detailed description and upon reference to the drawings.

DETAILED DESCRIPTION OF THE INVENTION

While the invention will be described in connection with the preferred embodiment, it will be understood that I do not intend to limit the invention to that embodiment. On the contrary, I intend to cover all alternatives, modifications, and equivalents as may be included within the spirit and the scope of the invention as defined by the appended claims.

Figure 1:
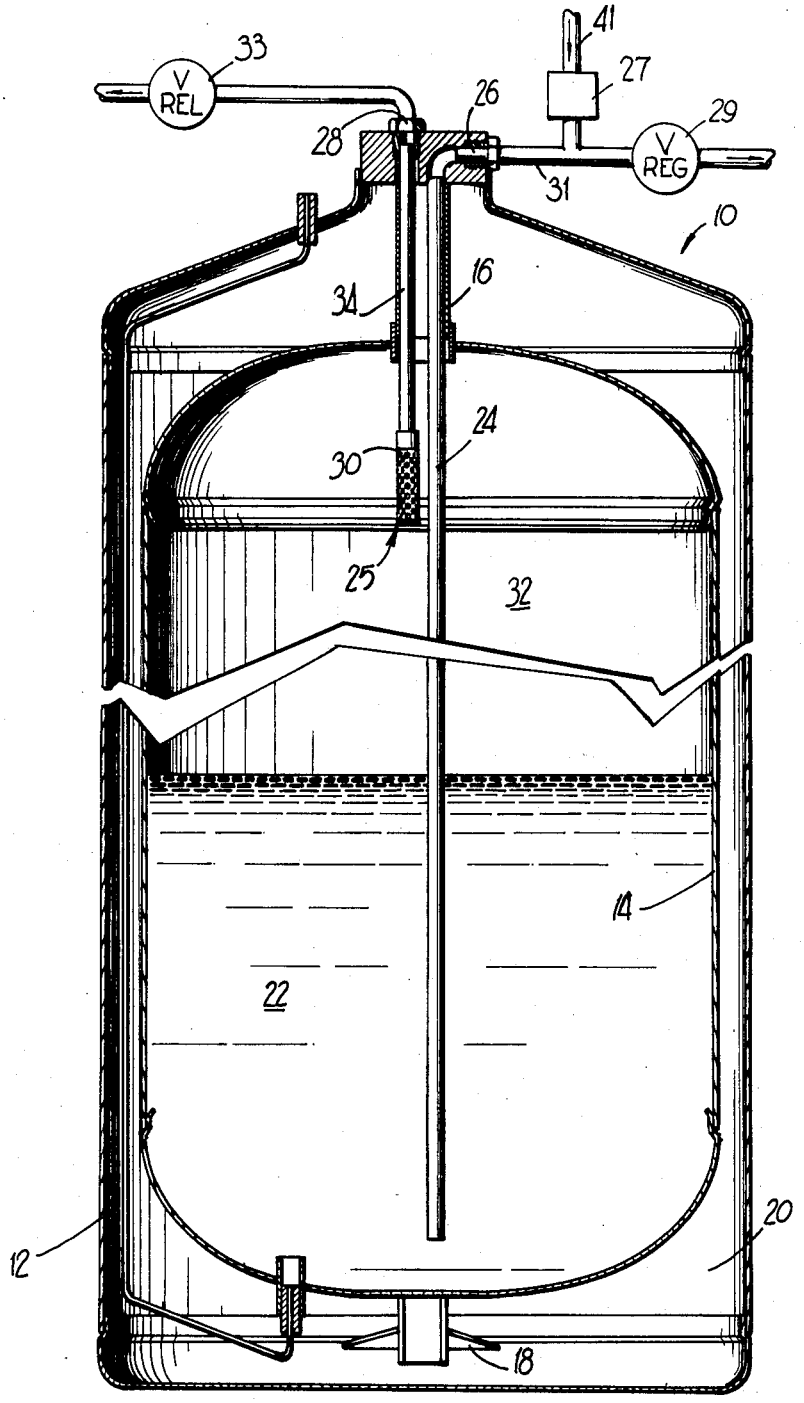
FIG. 1 is an elevation view, partly in vertical cross-section, showing a cryogenic tank embodying the present invention.

Turning to FIG. 1, there is shown a cryogenic tank 10 having an outer vessel 12 and an inner vessel 14. The inner vessel is suspended within the outer vessel by means of a neck 16 and a base support 18. The space 20 between the inner vessel and the outer vessel is evacuated to create a vaccuum and is insulated thereby minimizing the amount of heat transfer from the ambient atmosphere outside of the tank 10 to the contents of the inner vessel 14.

The inner vessel 14 contains liquified gas, such as $CO_2$, in the liquid phase 22 with a vapor phase 32 disposed above the liquid 22.

The neck 16 provides a sealable access port from outside of the tank 10 to the inside of inner vessel 14. An inlet/outlet pipe 24 for filling and emptying vessel 14 extends through the neck 16 and has an inlet/outlet port 26 at the top of the tank 10. The pipe 24 also extends nearly to the bottom of the inner vessel. A self closing coupling 27 and a pressure regulator 29 are connected to the inlet/outlet port 26 by means of pipe 31.

A pressure relief means 25 includes a vent tube 34 which extends through the neck 16 and which has an exhaust port 28 at its top end and an automatic valve 30 at its lower end. The automatic valve 30 only extends a short distance into the vapor space at the top of the inner vessel 14. A conventional pressure relief valve 33 is connected to exhaust port 28 and has a set point above the operating pressure (emptying pressure) of the tank and below the delivery pressure (filling pressure) of the tank.

Figure 2:
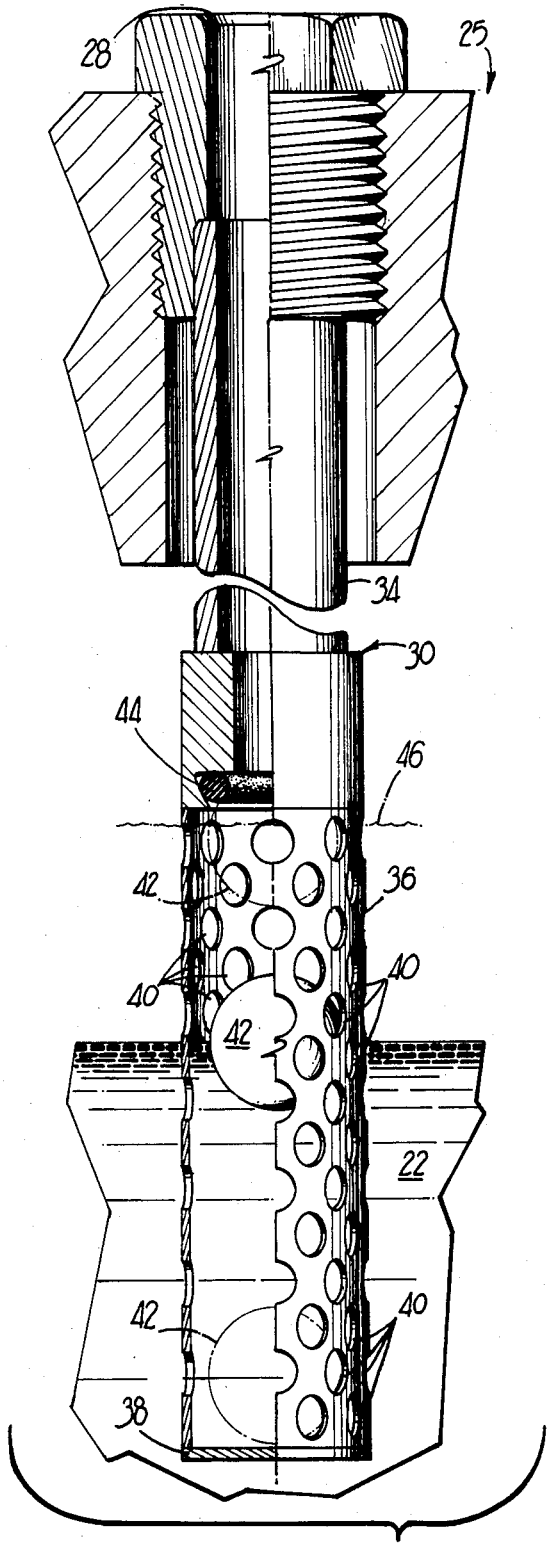
FIG. 2 is a detailed view, partly in cross-section, of an automatic venting means for the cryogenic tank of the present invention.

Turning to FIG. 2, the automatic pressure relief valve 30 includes a cylindrical housing 36 which is connected to the lower end of the vent tube 34. The housing 36 has a closed end 38 and sufficient perforations 40 along its length to allow entry of liquid 22. Enclosed within the housing is a buoyant float ball 42 which is of a suitable material having a density such that it floats within the cryogenic liquid 22. Near the top of the housing 36 there is provided an O-ring seat 44 which surrounds the bottom opening of the vent tube 34.

In order to fill the tank 10 (FIG. 1), a single delivery hose 41 from a transport tank (not shown) is connected to the inlet/outlet port 26 by means of the coupling 27 and pipe 31. The vapor pressure in the transport tank causes the cryogenic liquid in the transport tank to flow through the hose 41, through coupling 27, through pipe 31, through pipe 24, and into the inner vessel 14. As the cryogenic fluid 22 rises in the inner vessel 14, the vapor pressure increases until it exceeds the set point of relief valve 33. Once the set point of relief valve 33 is exceeded, the vapor 32 escapes through the automatic pressure relief valve 30, the vent tube 34, the exhaust port 28, and the conventional pressure relief valve 33, which has its set point below the pressure of the transport tank. Consequently, the vapor 32 is vented to the atmosphere instead of being compressed above the liquid 22 and creating back pressure sufficient to counteract the vapor pressure in the transport tank.

Once the cryogenic fluid 22 rises to a level 46 indicated in FIG. 2, the float ball 42 engages the O-ring 44 to seal off any further escape of vapor 32 from within the vapor space. Even after the valve 30 has been closed by means of the float ball 42, cryogenic fluid will continue to flow into the tank until the vapor pressure in the vapor space in the inner vessel 14 equals that of the vapor pressure in the transport tank. That further increase in the level of the liquid insures that the float ball is securely seated against the O-ring 44 to insure against further venting of vapor or escape of liquid during the filling process. Once the cyrogenic tank 10 has been filled, the hose 41 from the transport tank is uncoupled from self-closing coupling 27.

As the liquid 22 and gas 32 are subsequently withdrawn from vessel 14 through regulator 29, the pressure of the vapor 32 will be reduced below the set point of regulator 33, the liquid 22 will drop below the level 46 (FIG. 2), and the float ball 42 will drop from engagement with the O-ring 44. With the float ball 42 disengaged from O-ring 44, the tank 10 is ready for the next filling operation.

In filling tank 10 in FIG. 1, the small amount of $CO_2$ vapor that escapes during the filling operation through port 28 is less economically important than the cost of providing a skilled transport operator and/or sophisticated pumping and venting apparatus. Also, the cost of the vented $CO_2$ vapor is small when compared to the cost of additional delivery visits that would result if the tank 10 is only partially filled.

Figure 3:
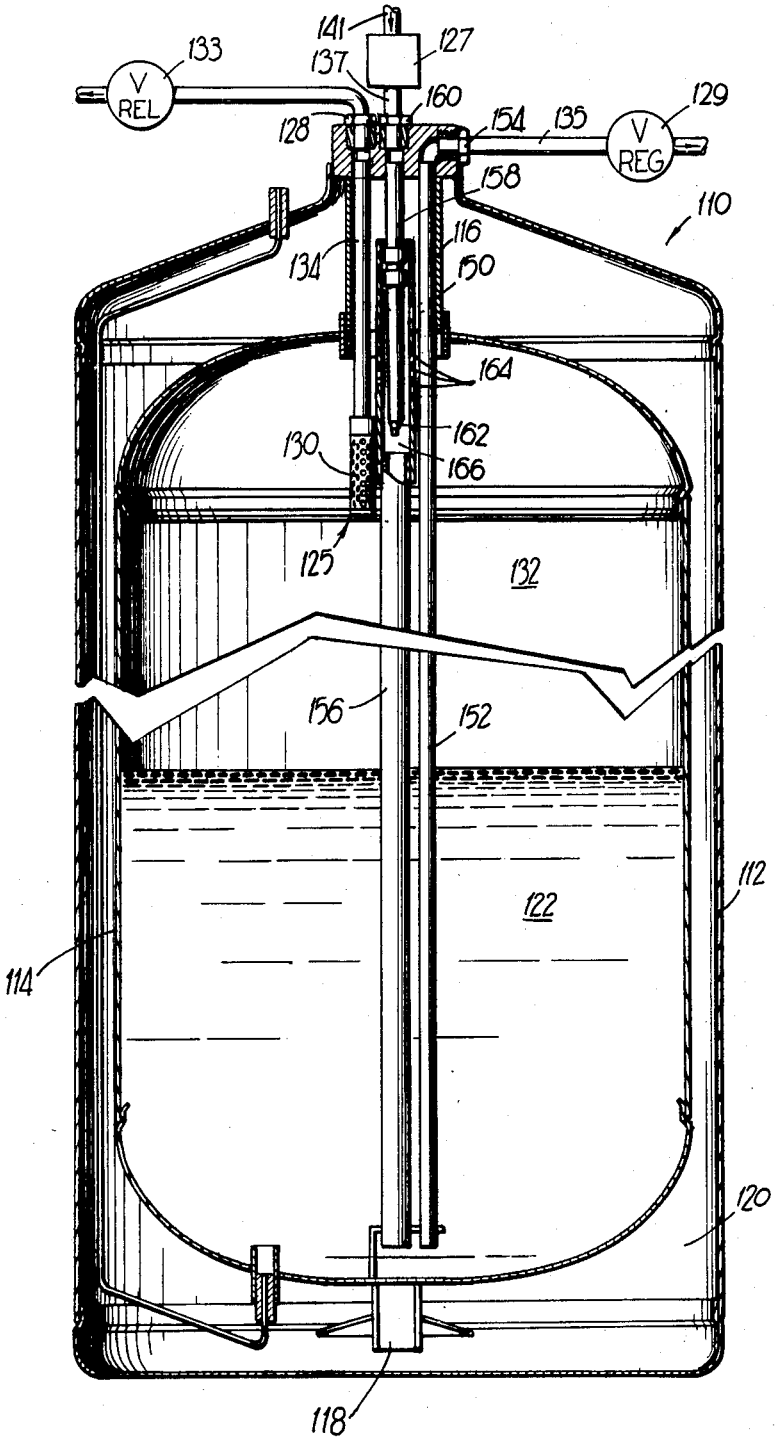
FIG. 3 is an elevation view, partly in vertical cross-section, showing another embodiment of the cryogenic tank including both automatic venting means and eductor means in combination.

In order, however, to minimize the loss of $CO_2$ gas during the filling operation, a second embodiment of a cryogenic tank 110 shown in FIG. 3 has an automatic pressure relief means 125 and an eductor 150 connected to inlet port 160. The eductor 150 entrains the $CO_2$ vapor 132 from the vapor space and carries it to the bottom of the tank during which the vapor is condensed thereby eliminating some of the vapor in the vapor space that otherwise would necessarily escape through the pressure relief means 125.

The cryogenic tank 110 shown in FIG. 3 is similar to tank 10 shown in FIG. 1, and the last two digits of the reference numerals in FIGS. 1 and 2 identify similar parts.

Cryogenic tank 110 has an outer vessel 112 and an inner vessel 114. The inner vessel 114 is suspended within the outer vessel 112 by means of a neck 116 and a base support 118. The space 120 between the inner vessel and the outer vessel is evacuated to create a vacuum and is insulated, thereby minimizing the amount of heat transfer from the ambient atmosphere outside of the tank 110 to the contents of the inner vessel 114.

The inner vessel 114 contains liquified gas, such as $CO_2$, in the liquid phase 122 with a vapor phase 132 disposed above the liquid 122.

The neck 116 provides a sealable access port from outside of the tank 110 to the inside of the inner vessel 114. An outlet pipe 152 extends through the neck 116 and has an outlet port 154 at the top of the tank 110. The outlet pipe 152 extends nearly to the bottom of the inner vessel 114 so that liquid 122 can be withdrawn for use. The outlet port 154 is connected via pipe 135 to regulator 129.

An inlet pipe 158 for filling inner vessel 114 extends through the neck 116 and has an inlet port 160 at the top of the tank 110. The inlet port 160 is connected via pipe 137 to self-closing coupling 127. An eductor 150 is connected to the lower end of the inlet pipe 158 near the top of the inner vessel 114. The eductor 150, shown in greater detail in FIG. 4, includes a nozzle 162 which is at the lower end of the eductor 150. The nozzle 162 may be either restricted or straight. The nozzle 162 is enclosed within a concentric tube 156 which extends nearly to the bottom of the inner vessel 114. The concentric tube 156 includes apertures 164 spaced around its circumference and positioned slightly above the nozzle 162.

In order to fill tank 110, a delivery hose 141 from a transport tank (now shown) is connected to the inlet port 160 by means of a standard self-closing coupling 127 and pipe 137. The vapor pressure in the transport tank causes the cryogenic liquid in the transport tank to flow through the hose 141 and into the inner vessel 114 through coupling 127, pipe 137, inlet port 160, inlet pipe 158, and eductor 150.

Figure 4:
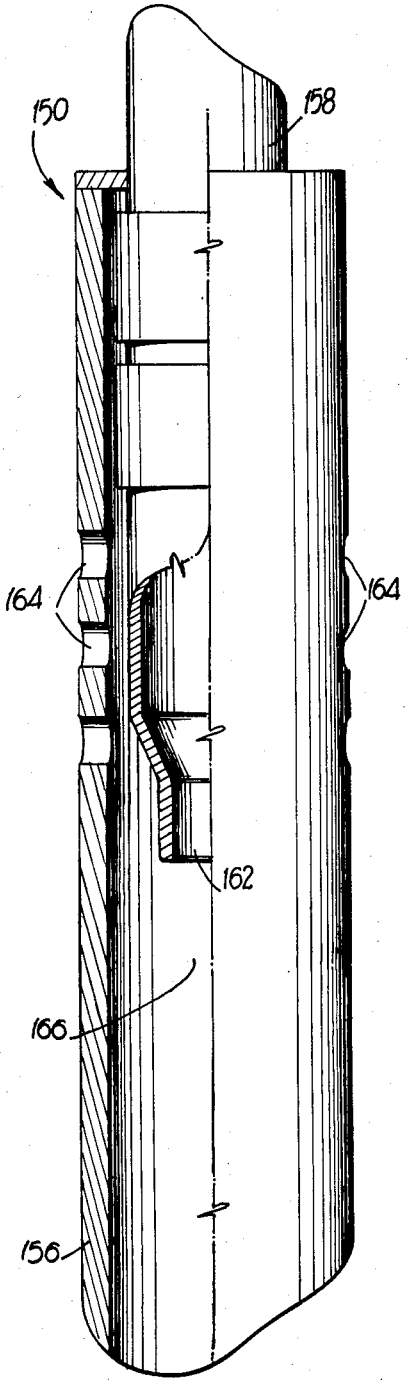
FIG. 4 is a detailed view, partly in cross-section, of an eductor for the cryogenic tank of FIG. 3.

As the liquid flows through the nozzle 162 of the eductor 150, the velocity of the liquid as it exits from the nozzle 162 creates a low pressure region in an area 166 within concentric tube 156 (FIG. 4). The low pressure in concentric tube 156 pulls vapor 132 from the vapor space above the liquid 122 through apertures 164 into the space 166 within concentric tube 156 where the vapor 132 is entrained with the incoming liquid exiting from the nozzle 162. As a result of the lowered pressure in space 166 and the entrainment of the vapor 132 with the liquid coming into the tank, some of the vapor 132 is condensed and carried to the bottom of the tank where it becomes part of the reservoir of liquid 122 in the tank.

While a substantial amount of vapor 132 in the vapor space will be entrained and condensed as a result of the use of the eductor 150, not all of the vapor 132 will be drawn out of the vapor space by the eductor. As the inner vessel 114 of tank 110 fills up, it is still necessary to vent some of the vapor 132 to the outside atmosphere to insure that the tank 110 is completely filled. In that regard, there is provided as previously described in connection with the tank 10 shown in FIG. 1, an automatic pressure relief means 125. The automatic pressure relief means 125 includes a vent tube 134 which extends through the neck 116 and which has an exhaust port 128 at its top end and an automatic valve 130 at its lower end. The automatic valve 130 only extends a short distance into the vapor space at the top of the inner vessel 114. A conventional pressure relief valve 133 is connected to the exhaust port 128. The pressure relief means 125 with its automatic pressure relief valve 130 and the conventional pressure relief valve 133 are the same as the pressure relief means 25 and pressure relief valve 33 shown in FIG. 2 and previously described.

As the inner vessel 114 fills up, and excess pressure is generated in the vapor space above the liquid 122, that excess pressure above the set point of relief valve 133 is vented through automatic pressure release means 125 and conventional pressure relief valve 133 to the outside atmosphere. The venting through relief means 125 continues until the automatic valve 130 is submerged in the rising liquid 122 and is shut off by means of the float ball within the valve 130.

Once the cryogenic tank 110 has been filled, the hose 141 from the transport truck is uncoupled from self-closing coupling 127. As the liquid and vapor are subsequently drawn off through outlet tube 152, outlet port 154, pipe 135, and regulator 127 for use, the liquid level and vapor pressure are sufficiently reduced to allow the float ball within automatic valve 130 to drop in anticipation of the next filling operation.

Figure 5:
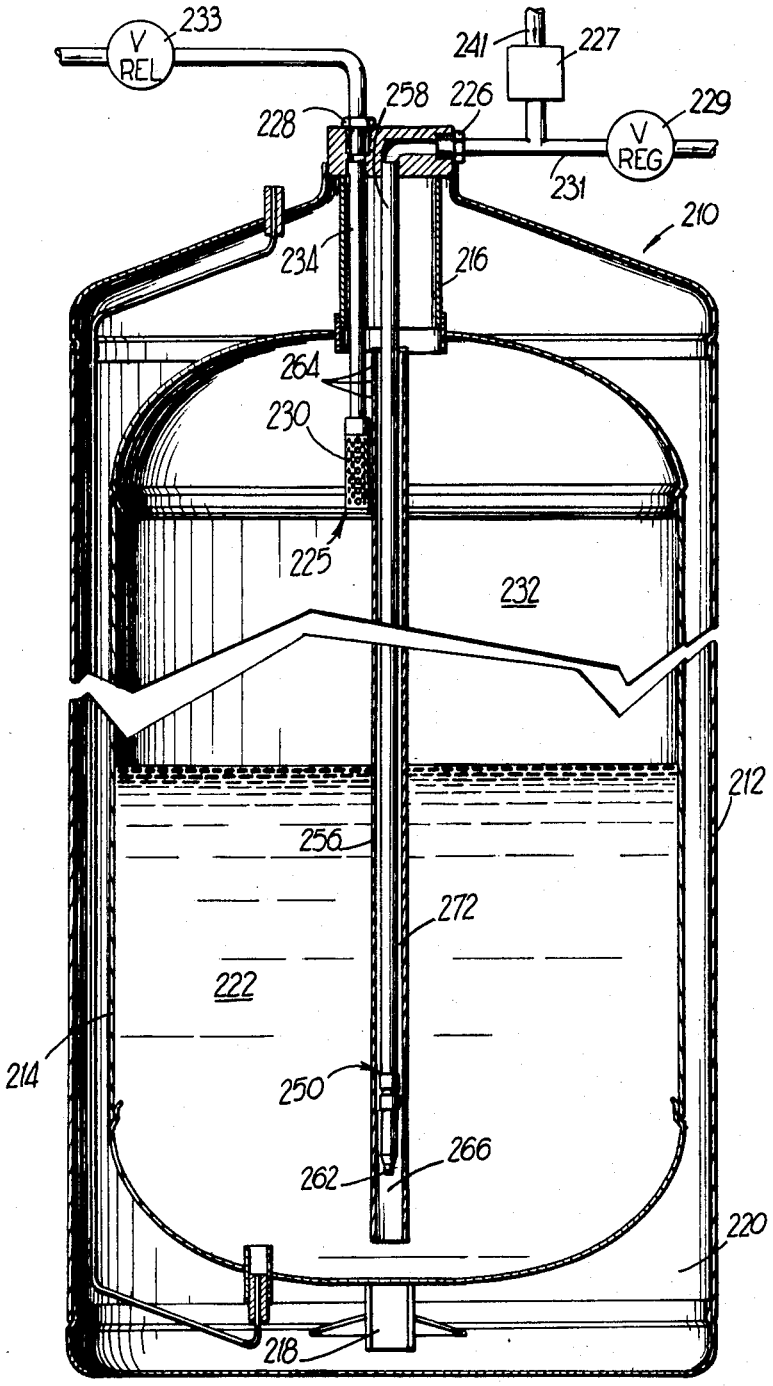
FIG. 5 is an elevatation view, partly in vertical cross-section, showing a further embodiment of the cryogenic tank showing automatic venting means in combination with eductor means.

Cryogenic tank 210 shown in FIG. 5 is similar to tank 110 shown in FIG. 3 and the last two digits of the reference numerals in FIG. 5 correspond to the last two digits of the reference numerals in FIG. 3 and FIG. 1 for similar parts.

The only difference between cryogenic tank 110 shown in FIG. 3 and the cryogenic tank 210 shown in FIG. 5 is that the nozzle 262 of the eductor 250 is positioned near the bottom of the tank instead of near the top of the tank, and there is no separate outlet pipe for tank 210.

Turning to FIG. 5, an inlet/outlet pipe 258 for filling and emptying vessel 214 extends through the neck 216 and extends to near the bottom of the inner vessel 214. The inlet/outlet pipe 258 has an inlet/outlet port 226 at its top end, and eductor 250 is connected to the lower end of the inlet/outlet pipe 258 near the bottom of the inner vessel 214. A self-closing coupling 227 and a pressure regulator 229 are connected to the inlet/outlet port 226 by means of pipe 231.

A concentric outer tube 256 is positioned around the inlet/outlet pipe 258, extends from the neck to slightly below the nozzle 262, and forms an annular space 272 with inlet pipe 258. The concentric tube 256 has apertures 264 spaced around its circumference near its top which provide passages between the vapor space and the annular space 272.

During the filling of the tank, the liquid flows from the transport tank, through hose 241, through coupling 227, through pipe 231, through the inlet/outlet port 226, through inlet/outlet pipe 258, and through eductor 250 with its nozzle 262. As the liquid flows through the nozzle 262 the velocity of the liquid as it exits from the nozzle 262 creates a low pressure region in an area 266 within tube 256. The low pressure created in the area 266 is communicated to the apertures 264 by means of the anular space 272 between the inlet pipe 258 and the tube 256. The reduced pressure in the anular space 272 draws vapor 232 through apertures 264 into the anular space 272 where the vapor contacts the cooled inlet/-outlet pipe 258 causing some of the vapor to condense on the inlet/outlet pipe. The rest of the vapor is drawn to the bottom of the anular space 272 into the area 266 where it is entrained with the liquid exiting from the nozzle 262 and further condensation takes place. As a result of the condensation and entrainment of the vapor 232, some of the vapor pressure above the liquid 222 is relieved as the tank fills, and therefore, less vapor 232 has to be vented through the automatic relief means 225 and pressure relief valve 233 which have been previously described in connection with FIGS. 1, 2, and 3.

Once the cryogenic tank 210 has been filled, the hose 241 from the transport truck is uncoupled from self-closing coupling 227. As liquid and vapor are subsequently drawn off through the inlet/outlet pipe 248, inlet/outlet port 226, pipe 231, and regulator 229 for use, the reduced liquid level and vapor pressure allow the float ball within automatic valve 230 to drop in anticipation of the next filling operation.

I claim:

1. A cryogenic tank for receiving, storing, and dispensing a cryogenic liquid with a vapor space adjacent the top of the tank above the liquid in the bottom of the tank, the tank comprising:

(a) an outer vessel;

(b) an inner vessel for containing the cryogenic liquid;

(c) an insulating space between the vessels;

(d) a sealable access port connected to the inner vessel to provide sealed access from outside the outer vessel to inside the inner vessel;

(e) an inlet tube extending from outside the outer vessel through the access port into the inner vessel and having an educator nozzle connected to its end within the inner vessel, wherein the eductor nozzle is enclosed within a concentric tube having apertures through which vapor is drawn from the vapor space into the concentric tube and condensed and entrained by action of the eductor and carried to the liquid and wherein the eductor nozzle is located within the vapor space adjacent the top of the tank, the concentric tube extends from the vapor space into the liquid in the bottom of the tank, and an outlet tube extends from outside the outer vessel through the access port into the cryogenic liquid; and (f) vapor pressure relief means extending from outside the outer vessel through the access port into the vapor space and comprising a vent tube having a closable end outside of the tank and a float valve at the vent tube's end disposed within the vapor space wherein the float value comprises a buoyant ball enclosed within a perforated housing, the ball being disposed to float within the housing into engagement with a seat to close the vent tube.

2. A cryogenic tank for receiving, storing, and dispensing a cryogenic liquid with a vapor space adjacent the top of the tank above the liquid in the bottom of the tank, the tank comprising:

(a) an outer vessel;

(b) an inner vessel for containing the cryogenic liquid;

(c) an insulating space between the vessels;

(d) a sealable access port connected to the inner vessel to provide sealed access from outside the outer vessel to inside the inner vessel;

(e) an inlet tube extending from outside the outer vessel through the acess port into the inner vessel and having an eductor nozzle connected to its end within the inner vessel, wherein the eductor nozzle is enclosed within a concentric tube having apertures through which vapor is drawn from the vapor space into the concentric tube and condensed and entrained by action of the eductor and carried to the liquid and wherein the eductor nozzle extends into the liquid in the bottom of the tank and the concentric tube extends from the vapor space into the liquid in the bottom of the tank so that the inlet tube serves as an outlet; and (f) vapor pressure relief means extending from outside the outer vessel through the access port into the vapor space and comprising a vent tube having a closable end outside of the tank and a float valve at the vent tube's end disposed within the vapor space wherein the float value comprises a buoyant ball enclosed within a perforated housing, the ball being disposed to float within the housing into engagement with a seat to close the vent tube.

* * * * *